US009908746B2

(12) United States Patent
Yu et al.

(10) Patent No.: US 9,908,746 B2
(45) Date of Patent: Mar. 6, 2018

(54) ELEVATOR SYSTEM SOUND REDUCING ASSEMBLY AND METHOD

(71) Applicant: OTIS ELEVATOR COMPANY, Farmington, CT (US)

(72) Inventors: Zheng Yu, Unionville, CT (US); Senzo Alberto Naruke, Kanagawa (JP); Lili Ren, Shanghai (CN); Takeshi Minowa, Chiba-Ken (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/208,209

(22) Filed: Jul. 12, 2016

(65) Prior Publication Data

US 2017/0015525 A1 Jan. 19, 2017

(30) Foreign Application Priority Data

Jul. 13, 2015 (CN) ..... 2015 1 0408568

(51) Int. Cl.

| | |
|---|---|
| ***B66B 11/00*** | (2006.01) |
| ***B66B 7/00*** | (2006.01) |
| ***B66B 7/02*** | (2006.01) |
| ***B66B 9/00*** | (2006.01) |

(52) U.S. Cl.

CPC ..... *B66B 11/0005* (2013.01); *B66B 7/00* (2013.01); *B66B 7/021* (2013.01); *B66B 9/00* (2013.01)

(58) Field of Classification Search

CPC ..... B66B 11/0005; B66B 7/00; B66B 7/021; B66B 9/00

See application file for complete search history.

(56) References Cited

U.S. PATENT DOCUMENTS

| | | | | |
|---|---|---|---|---|
| 763,976 | A | 7/1904 | Gurney | |
| 3,945,468 | A * | 3/1976 | Miura | B66B 11/0226 187/401 |
| 5,018,602 | A * | 5/1991 | Salmon | B66B 11/026 187/401 |
| 5,080,201 | A * | 1/1992 | Yoo | B66B 17/12 187/404 |

(Continued)

FOREIGN PATENT DOCUMENTS

| | | |
|---|---|---|
| CN | 102219141 A | 10/2011 |
| CN | 202107408 U | 1/2012 |

(Continued)

OTHER PUBLICATIONS

Search Report regarding related EP App. No. 16 17 9317; dated Nov. 30, 2016; 10 pgs.

*Primary Examiner* — Michael A Riegelman
(74) *Attorney, Agent, or Firm* — Cantor Colburn LLP

(57) ABSTRACT

An elevator system sound reducing assembly includes an elevator car moveably disposed in an elevator shaft. Also included is a counterweight moveably disposed in the elevator shaft, the counterweight operatively coupled to and guided along a counterweight frame. Further included is a barrier located at a height of the elevator shaft that corresponds to passage of the elevator car and the counterweight relative to each other, the barrier disposed between the counterweight and the elevator car upon passage of the elevator car and the counterweight.

15 Claims, 4 Drawing Sheets

(56) References Cited

U.S. PATENT DOCUMENTS

| | | | | |
|---|---|---|---|---|
| 5,220,979 | A * | 6/1993 | Matsuda | B66B 11/0226 187/401 |
| 5,251,726 | A * | 10/1993 | de Jong | B66B 11/0226 187/401 |
| 7,665,583 | B2 | 2/2010 | Kuipers | |
| 9,604,822 | B2 * | 3/2017 | Roivainen | B66B 13/301 |
| 2006/0289242 | A1 * | 12/2006 | Oberer | B66B 13/285 187/333 |
| 2008/0000728 | A1 * | 1/2008 | Kuipers | B66B 11/0005 187/406 |
| 2010/0116597 | A1 * | 5/2010 | Matsuda | B66B 11/028 187/401 |
| 2016/0031677 | A1 * | 2/2016 | Roivainen | B66B 17/12 187/254 |

FOREIGN PATENT DOCUMENTS

| | | | |
|---|---|---|---|
| CN | 202657804 | U | 1/2013 |
| JP | S4887541 | A | 11/1973 |
| JP | S5269140 | A | 6/1977 |
| JP | H04169490 | A | 6/1992 |
| JP | H09290982 | A | 11/1997 |
| JP | H10236751 | A | 9/1998 |
| JP | 1160113 | A | 3/1999 |
| JP | 2000255941 | A | 9/2000 |
| JP | 2004196533 | A | 7/2004 |
| JP | 2006124142 | A | 5/2006 |
| JP | 2014223958 | A | 12/2014 |
| KR | 20000052033 | A | 8/2000 |
| WO | 0035800 | A1 | 6/2000 |

* cited by examiner

ELEVATOR SYSTEM SOUND REDUCING ASSEMBLY AND METHOD

CROSS REFERENCE TO RELATED APPLICATION

This patent application claims priority to Chinese Patent Application Serial No. 201510408568.1, filed Jul. 13, 2015, which is incorporated herein by reference in its entirety.

BACKGROUND OF THE DISCLOSURE

The embodiments herein relate to elevator systems and, more particularly, to a sound reducing assembly for such elevator systems, as well as a method of reducing sound in an elevator system.

Elevator systems include an elevator car, a counterweight and a tension member (e.g., rope, belt, cable, etc.) that connects the hoisted structure and the counterweight. During operation, the elevator car and the counterweight pass each other in an elevator shaft. During this passage, a turbulent airflow is generated which leads to noise and/or vibration that are detected by passengers within the elevator car. This undesirable aspect is often referred to as "bypass noise."

Efforts to reduce bypass noise have included the use of counterweight shrouds, for example, which are coupled to the counterweight and move therewith. Shrouds require a streamlined and aerodynamic design, thereby leading to a high manufacturing cost. In addition to the costliness noted above, bypass noise is still typically present to some degree with the use of shrouds. It would be desirable for elevator system manufacturers and operators to reduce or eliminate bypass noise.

BRIEF DESCRIPTION OF THE DISCLOSURE

According to one embodiment, an elevator system sound reducing assembly includes an elevator car moveably disposed in an elevator shaft. Also included is a counterweight moveably disposed in the elevator shaft, the counterweight operatively coupled to and guided along a counterweight frame. Further included is a barrier located at a height of the elevator shaft that corresponds to passage of the elevator car and the counterweight relative to each other, the barrier disposed between the counterweight and the elevator car upon passage of the elevator car and the counterweight.

In addition to one or more of the features described above, or as an alternative, further embodiments may include that the barrier is operatively coupled to the counterweight frame.

In addition to one or more of the features described above, or as an alternative, further embodiments may include that the barrier is directly coupled to the counterweight frame.

In addition to one or more of the features described above, or as an alternative, further embodiments may include that the elevator car comprises a car height, the counterweight comprises a counterweight height, and the barrier comprises a minimum barrier height of at least half of the difference of the car height and the counterweight height.

In addition to one or more of the features described above, or as an alternative, further embodiments may include that the minimum barrier height is at least half of the difference of the car height and the counterweight height plus a tolerance dimension.

In addition to one or more of the features described above, or as an alternative, further embodiments may include that the barrier comprises a maximum barrier height of less than or equal to half of the sum of the car height and the counterweight height.

In addition to one or more of the features described above, or as an alternative, further embodiments may include that the maximum barrier height is at least half of the sum of the car height and the counterweight height plus a tolerance dimension.

In addition to one or more of the features described above, or as an alternative, further embodiments may include that the barrier comprises a dampening material.

In addition to one or more of the features described above, or as an alternative, further embodiments may include that the barrier comprises a sound absorbing material.

In addition to one or more of the features described above, or as an alternative, further embodiments may include that the barrier is at least partially formed of sheet metal.

In addition to one or more of the features described above, or as an alternative, further embodiments may include that the barrier comprises a planar main region, a first end region and a second end region, at least one of the end regions being oriented at an angle from the planar main region.

In addition to one or more of the features described above, or as an alternative, further embodiments may include that the angle ranges from 30 degrees to 150 degrees.

In addition to one or more of the features described above, or as an alternative, further embodiments may include that the at least one end region is angled toward the counterweight.

In addition to one or more of the features described above, or as an alternative, further embodiments may include that at least one of the end regions comprises a plurality of apertures.

In addition to one or more of the features described above, or as an alternative, further embodiments may include that the end regions each comprise one of a rectangular geometry and a triangular geometry.

According to one embodiment, a method of reducing sound in an elevator system is provided. The method includes translating an elevator car within an elevator shaft. The method also includes translating a counterweight within the elevator shaft along a counterweight frame that the counterweight is operatively coupled to. The method further includes operatively coupling a barrier to the counterweight frame at a height of the elevator shaft that prevents an exposed passage of the elevator car and the counterweight, wherein the barrier height ranges from a minimum height of half of the difference between a car height and a counterweight height to a maximum height of half of the sum of the car height and the counterweight height plus a tolerance dimension.

BRIEF DESCRIPTION OF THE DRAWINGS

The subject matter which is regarded as the disclosure is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION OF THE DISCLOSURE

Figure 1:
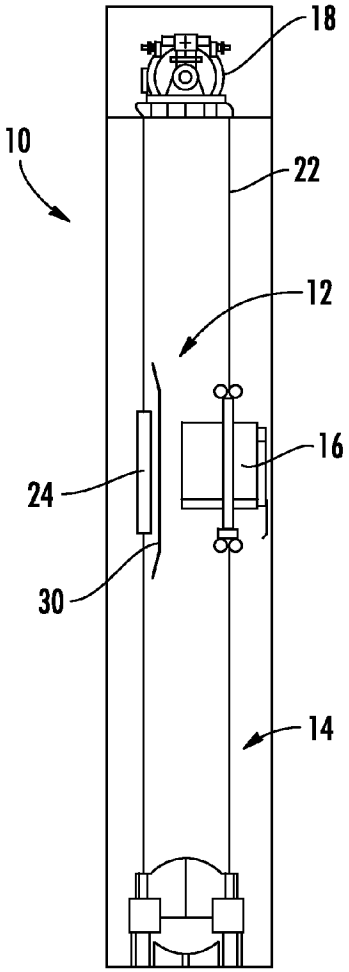
FIG. 1 is a simplified elevational view of an elevator system.

Referring to FIG. 1, an elevator system 10 is illustrated and includes an elevator car 16 that is disposed within an elevator shaft 14 and is moveable therein, typically in a vertical manner. A drive system 18 includes a motor and brake and is conventionally used to control the vertical movements of the elevator car 16 along the elevator shaft 14 via a traction system that includes cables, belts or the like 22 and at least one pulley. Described herein is a sound reducing assembly 12 that reduces undesirable noise and/or vibration detected by passengers of the elevator car 16 during movement of the elevator car 16.

A counterweight 24 is also disposed within the elevator shaft 14 and is moveable therein. The counterweight 24 moves in a direction that opposes the elevator car 16 during operation of the system to provide a balancing force for the elevator system 10. As shown, a certain region of the elevator shaft 14 is a bypass region where at least a portion of the elevator car 16 and the counterweight 24 are located at the same height in the elevator shaft 14. Overlapping travel of these components results in generation of a turbulent airflow which leads to noise and/or vibration detected by passengers within the elevator car 16. This undesirable aspect is often referred to as "bypass noise." To reduce or eliminate bypass noise, the embodiments described herein incorporate a barrier 30 that is located in the bypass region and between the elevator car 16 and the counterweight 24 during passage of the components within the bypass region. As will be appreciated from the description herein, the barrier 30 is dimensioned and shaped to avoid a direct and unimpeded sight line between the elevator car 16 and the counterweight 24. While the barrier 30 is primarily described below as being operatively coupled to the counterweight 24, it is to be understood that some embodiments include the barrier 30 being operatively coupled to a different structural feature. For example, the barrier 30 may be coupled to the elevator car, an elevator guide rail structure, a suspension, etc. As will be appreciated from the description herein, regardless of the structural feature that the barrier 30 is coupled to, the barrier is located between the counterweight 24 and the elevator car 16 during passage of the structures within the elevator shaft.

Figure 2:
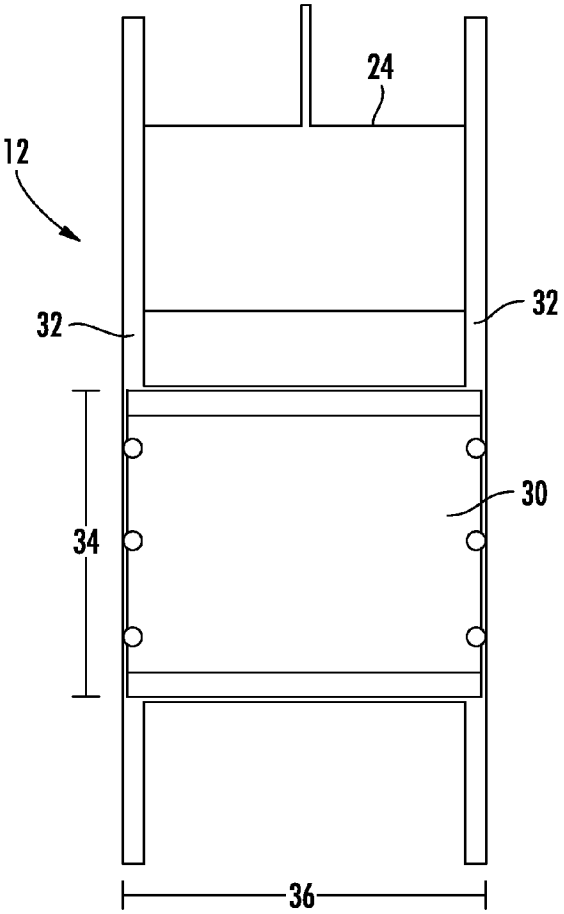
FIG. 2 is an elevational view of a barrier and a counterweight operatively coupled to a counterweight frame.

Referring now to FIG. 2, the counterweight 24 is operatively coupled to a counterweight frame 32 that extends along a longitudinal direction (e.g., vertical) of the elevator shaft 14. The counterweight 24 is sized to be guided along the counterweight frame 32 during movement of the counterweight 24 within the elevator shaft 14. The barrier 30 is also operatively coupled to the counterweight frame 32. Any coupling process may be employed and the coupling may be direct or indirect. The barrier 30 is a stationary member that is fixed relative to the counterweight frame 32. The barrier 30 may be formed from various suitable materials. In one embodiment, the barrier 30 is formed of a sheet metal panel. In addition to the position and base material of the barrier 30, enhancement of the sound reducing effects of the barrier 30 may be made in some embodiments with treatment of the barrier 30 with one or more layers of substance(s). For example, a material that assists with sound damping or absorption may be applied to an outer surface of the barrier 30. The barrier 30 may be a single, integrally formed component or may be formed of multiple pieces that are assembled.

The barrier 30 comprises a barrier height 34 and a barrier width 36. The barrier width 36 is equal to or greater than the horizontal distance between two counter weight frames to completely block potential paths of the components during movement through the bypass region. The height of the barrier 30 will be discussed in detail below.

Figure 3:
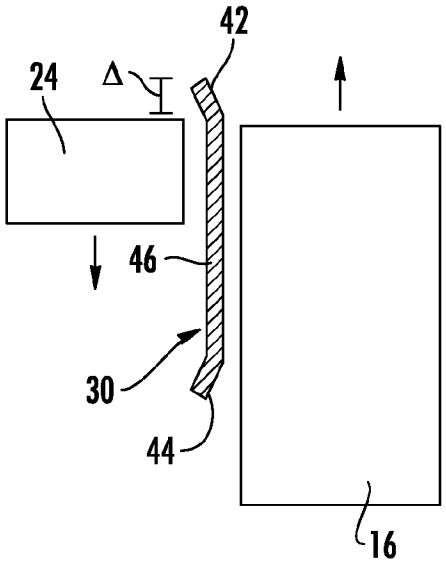
FIG. 3 is a schematic view of a sound reducing assembly for the elevator system illustrating an elevator car and the counterweight in a first position.
Figure 4:
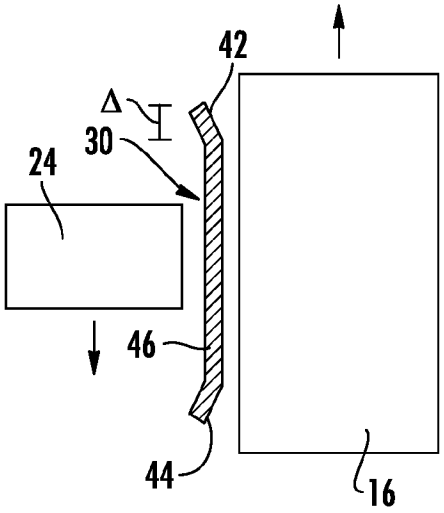
FIG. 4 is a schematic view of the sound reducing assembly for the elevator system illustrating the elevator car and the counterweight in a second position.
Figure 5:
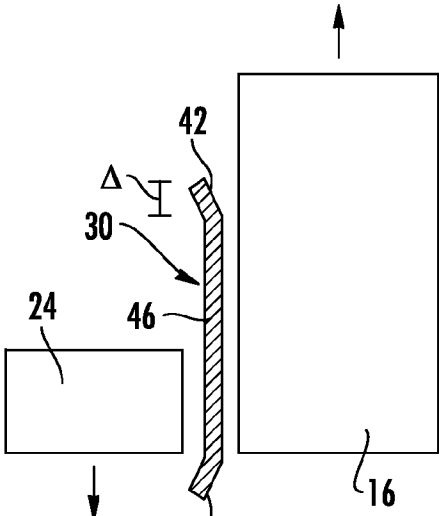
FIG. 5 is a schematic view of the sound reducing assembly for the elevator system illustrating the elevator car and the counterweight in a third position.

Referring to FIGS. 3-5, the sound reducing assembly 12 is illustrated at three distinct operating positions. The elevator car 16 and the counterweight 24 are shown during operation and moving in opposite directions. The three illustrated positions depict the elevator car 16 and the counterweight 24 during a passing event in the bypass region where the barrier 30 is positioned. As shown, there is no position during passage of the elevator car 16 and the counterweight 24 when any portion of the elevator car 16 and the counterweight 24 are at the same height and exposed to each other. This advantageously reduces or eliminates sound and/or vibration during the passing event.

The barrier height 34 is sized to ensure the above-described condition. In particular, the barrier height 34 ranges from minimum barrier height to a maximum barrier height. The maximum height of the barrier 30 is defined in a manner that the enables the barrier to reach the maximum performance of bypass noise reduction while minimizing material cost. However, it is to be understood that the height of barrier may be longer than the above defined maximum height of the barrier if the cost of material is not an issue. In one embodiment, the minimum barrier height is at least half of the difference of the elevator car height and the counterweight height and is represented by the following equation:

$$H_b \geq \frac{(H_{car} - H_{cwt})}{2}$$

where $H_b$=height of the barrier 30, $H_{car}$=height of the elevator car 16, and $H_{cwt}$=height of the counterweight 24.

In another embodiment, the minimum barrier height includes a tolerance dimension and is represented by the following equation:

$$H_b \geq \frac{(H_{car} - H_{cwt})}{2} + 2\Delta$$

where Δ is a tolerance dimension.

The tolerance dimension Δ may correspond to an angled end region of the barrier 30. The barrier 30 includes a first end region 42 and a second end region 44 that are on opposite ends of a planar region 46. The first and second end regions 42, 44 may be of the same or distinct dimensions and/or geometries. In the illustrated embodiment of FIGS.

Figure 8:
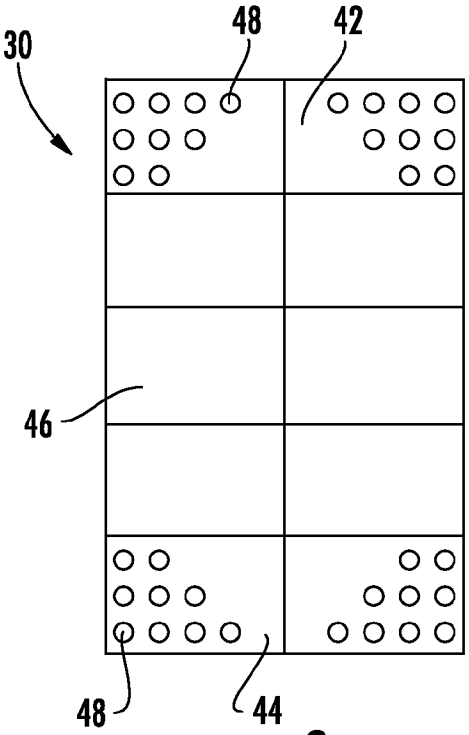
FIG. 8 is an elevational view of the barrier according to a third embodiment.
Figure 7:
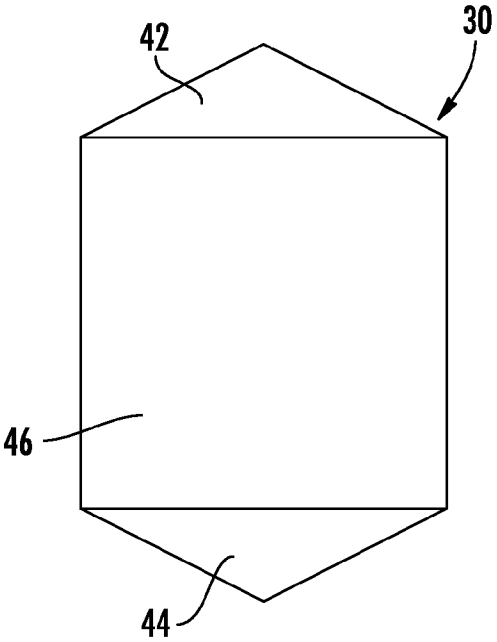
FIG. 7 is an elevational view of the barrier according to a second embodiment.
Figure 6:
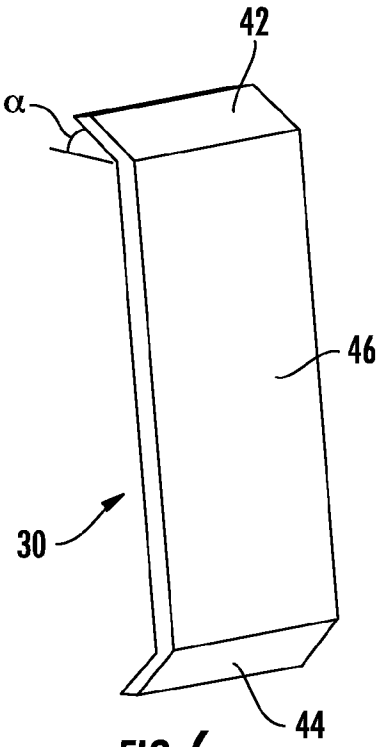
FIG. 6 is a perspective view of the barrier according to a first embodiment.

3-6, the first and second end regions 42, 44 are substantially rectangular shaped, while the embodiment of FIG. 7 includes tapering end regions that form a triangular geometry. Furthermore, it is to be appreciated that the end regions 42, 44 include a plurality of apertures 48 in some embodiments, such as that illustrated in FIG. 8.

In the illustrated embodiments, the first and second end regions 42, 44 are angled toward the counterweight 24, but it is to be understood that angling toward the elevator car 16 is contemplated. The extent of angling of the first and second end regions 42, 44 may vary depending upon the particular application. In one embodiment, the angle ∂ ranges from about 30 degrees to about 150 degrees.

Figure 9:
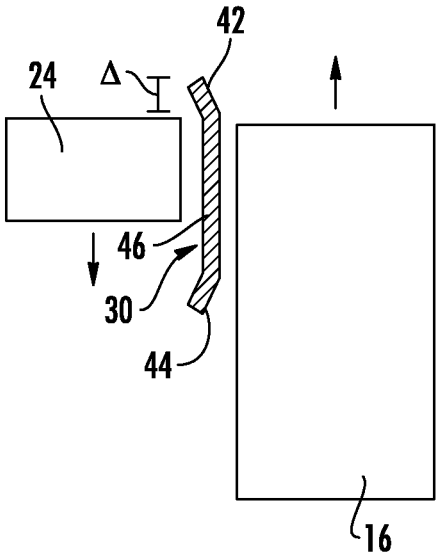
FIG. 9 is a schematic view of the sound reducing assembly for the elevator system illustrating another aspect of the disclosure.

Returning to the height ranges of the barrier 30, in one embodiment the maximum height of the barrier 30 is less than or equal to about half of the sum of the elevator car height and the counterweight height, as shown in FIG. 9, and is represented by the following equation:

$$H_b \leq \frac{(H_{car} + H_{cwt})}{2}$$

In another embodiment, the tolerance dimension Δ is factored into the maximum height of the barrier 30 and is represented by the following equation:

$$H_b \leq \frac{(H_{car} + H_{cwt})}{2} + 2\Delta$$

To reiterate, it is to be understood that the height of barrier may be longer than the above defined maximum height if the cost of material is not an issue.

The position, dimensions and geometry of the barrier 30 advantageously reduce or eliminate bypass noise felt by passengers in the elevator car 16. The benefits of the embodiments described herein include the bypass noise reduction, as well as cost savings over alternative sound reducing assemblies. In particular, the barrier 30 has a low manufacturing cost associated with it and a low assembly cost, when compared to alternative assemblies, such as a shroud, for example.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. An elevator system sound reducing assembly comprising:

an elevator car moveably disposed in an elevator shaft;

a counterweight moveably disposed in the elevator shaft, the counterweight operatively coupled to and guided along a counterweight frame; and a barrier located at a height of the elevator shaft that corresponds to passage of the elevator car and the counterweight relative to each other, the barrier disposed between the counterweight and the elevator car upon passage of the elevator car and the counterweight, wherein the barrier is directly coupled to the counterweight frame.

2. The assembly of claim 1, wherein the barrier is operatively coupled to the counterweight frame.

3. The assembly of claim 1, wherein the elevator car comprises a car height, the counterweight comprises a counterweight height, and the barrier comprises a minimum barrier height of at least half of the difference of the car height and the counterweight height.

4. The assembly of claim 3, wherein the minimum barrier height is at least half of the difference of the car height and the counterweight height plus a tolerance dimension.

5. The assembly of claim 1, wherein the barrier comprises a maximum barrier height of less than or equal to half of the sum of the car height and the counterweight height.

6. The assembly of claim 5, wherein the maximum barrier height is at least half of the sum of the car height and the counterweight height plus a tolerance dimension.

7. The assembly of claim 1, wherein the barrier comprises a dampening material.

8. The assembly of claim 1, wherein the barrier comprises a sound absorbing material.

9. The assembly of claim 1, wherein the barrier is at least partially formed of sheet metal.

10. The assembly of claim 1, wherein the barrier comprises a planar main region, a first end region and a second end region, at least one of the end regions being oriented at an angle from the planar main region.

11. The assembly of claim 10, wherein the angle ranges from 30 degrees to 150 degrees.

12. The assembly of claim 10, wherein the at least one end region is angled toward the counterweight.

13. The assembly of claim 10, wherein at least one of the end regions comprises a plurality of apertures.

14. The assembly of claim 10, wherein the end regions each comprise one of a rectangular geometry and a triangular geometry.

15. A method of reducing sound in an elevator system comprising:

translating an elevator car within an elevator shaft;

translating a counterweight within the elevator shaft along a counterweight frame that the counterweight is operatively coupled to; and directly coupling a barrier to the counterweight frame at a height of the elevator shaft that prevents an exposed passage of the elevator car and the counterweight, wherein the barrier height ranges from a minimum height of half of the difference between a car height and a counterweight height to a maximum height of half of the sum of the car height and the counterweight height plus a tolerance dimension.

* * * * *